US005295673A

United States Patent [19]

Torisawa et al.

[11] Patent Number: 5,295,673

[45] Date of Patent: * Mar. 22, 1994

[54] METHOD OF AND DEVICE FOR CONTROLLING FEEDING OF SHEETS BY DETECTING MULTIPLE SHEET PICK UP

[75] Inventors: Nobuyuki Torisawa; Toshihiro Suya; Norikazu Soga, all of Minami-ashigara, Japan

[73] Assignee: Fuji Photo Film Co., Ltd., Kanagawa, Japan

[ * ] Notice: The portion of the term of this patent subsequent to Aug. 11, 2009 has been disclaimed.

[21] Appl. No.: 800,134

[22] Filed: Nov. 29, 1991

[30] Foreign Application Priority Data

Nov. 29, 1990 [JP] Japan ..... 2-331955
Nov. 29, 1990 [JP] Japan ..... 2-331956

[51] Int. Cl.[5] ..... B65H 3/30

[52] U.S. Cl. ..... 271/11; 271/104; 271/106; 271/263

[58] Field of Search ..... 271/11, 90, 104, 106, 271/225, 262, 263, 98

[56] References Cited

U.S. PATENT DOCUMENTS

| | | | |
|---|---|---|---|
| 2,846,220 | 8/1958 | Mestre . | |
| 2,942,877 | 6/1960 | Fowlie et al. . | |
| 3,627,308 | 12/1971 | Stoever . | |
| 3,993,303 | 11/1976 | Riepl et al. | 271/263 |
| 4,148,473 | 4/1979 | Johnson . | |
| 4,428,793 | 1/1984 | Sato et al. | 271/106 X |
| 4,854,569 | 8/1989 | Mizuta . | |
| 4,936,566 | 6/1990 | Hiramatsu | 271/259 X |
| 5,064,183 | 11/1991 | Nishigaki et al. | 271/10 |
| 5,137,268 | 8/1992 | Suya et al. | 271/106 X |

FOREIGN PATENT DOCUMENTS

| | | | |
|---|---|---|---|
| 0436892 | 7/1991 | European Pat. Off. . | |
| 29072 | 3/1977 | Japan | 271/98 |
| 21373 | 2/1980 | Japan | 271/98 |
| 55-50669 | 11/1980 | Japan . | |
| 57-1140 | 1/1982 | Japan . | |
| 64-22745 | 1/1989 | Japan . | |
| 1402394 | 6/1988 | U.S.S.R. | 271/106 |
| 8101824 | 7/1981 | World Int. Prop. O. | 271/263 |

*Primary Examiner*—D. Glenn Dayoan
*Assistant Examiner*—Boris Milef
*Attorney, Agent, or Firm*—Sughrue, Mion, Zinn, Macpeak & Seas

[57] ABSTRACT

Photographic light-sensitive mediums such as sheets are fed one by one by a suction pad in a sheet-feed control device. The suction pad is displaced downward at a low speed in a position near a stack of sheets so as to approach an uppermost one of the sheets, thereby attracting the uppermost sheet to the suction pad, and the uppermost sheet is flexed by a sheet presser while it is being separated away from the other sheets. Then, a judgement is made as to whether the suction pad attracts either a single sheet or a plurality of sheets, by detecting the magnitude of the flexion of the sheet or sheets attracted. Then, the suction pad is displaced again toward the position where the uppermost sheet is to be attracted, when it is detected that the suction pad has attracted the plurality of sheets. At this time, the suction pad is placed in a given stop position, thereby releasing the plurality of sheets from the suction pad. It is then detected whether the plurality of sheets have been released from the suction pad. After the plurality of sheets have been released from the suction pad, the suction pad is displaced again toward the position where the suction pad attracts the uppermost sheet so as to attract and hold the uppermost sheet.

7 Claims, 8 Drawing Sheets

METHOD OF AND DEVICE FOR CONTROLLING FEEDING OF SHEETS BY DETECTING MULTIPLE SHEET PICK UP

BACKGROUND OF THE INVENTION

1. Field of the Invention

The present invention rebates to a method of and a device for controlling the feeding of sheets one by one, of a type wherein when a plurality of sheets attracted under suction by a suction pad is detected, sheet feeding motion of the suction pad is changed, thereby making it possible to prevent the plurality of sheets from being fed simultaneously.

2. Description of the Related Art

In a conventional sheet feeding device, an uppermost sheet of stacked sheets, for example, stacked photographic light-sensitive mediums, is attracted under suction by a suction pad communicating with a vacuum source to be fed to a predetermined position. More specifically, sheets, for example, photographic light-sensitive mediums (e.g., an X-ray film and graphic art films, etc.), are taken out one by one from a supply magazine in which the sheets have been accommodated in a stacked state, so as to feed under suction of a suction pad to the succeeding stations (e.g., an exposure station, a developing station, etc.).

When a plurality of the sheets adhere to one another owing to the static electricity or the like, these sheets are to be simultaneously fed to the succeeding station. In the conventional sheet feeding device, the suction pad is normally displaced toward the sheets by a given stroke without taking into consideration the remaining quantity of stacked sheets to be fed. In order to attract an uppermost sheet by the suction pad after the suction pad is pressed against the uppermost sheet, air is forced out from the adjacent sheets, so that the sheets adhere firmly to one another. As a result, a plurality of sheets are simultaneously attracted and held by the suction pad, thus interfering with the following sheet feeding operation of the suction pad in the device. Therefore, the device has to be stopped to correct such malfunction.

In order to avoid such malfunction to be caused in advance, the uppermost sheet attracted by the suction pad is first introduced into a device, comprising a pair of rollers which dislocate in proportion to the thickness of the sheet interposed between the rollers, thereby detecting whether or not a plurality of sheets have been taken out simultaneously. More specifically, the thickness of a single sheet to be inserted between the rollers is set to a thickness detector which detects dislocation of the rollers in proportion to the thickness of the sheet in advance. When two or more sheets are interposed between the rollers, the two rollers are separated from each other beyond the range set in the thickness detector. Since the dislocation is proportional to the thickness of the sheet to be fed it is therefore possible to determine whether or not a plurality of sheets have been fed simultaneously.

In case the thickness detector in the above is used for the detection as to whether or not a plurality of sheets have been fed simultaneously, it is difficult to exactly determine whether a plurality of sheets or a single sheet is fed, since the thickness of each sheet such as a photographic light-sensitive medium is thin (about 0.2 mm) in general. When a plurality of sheets is fed and interposed between the rollers, the rollers damage the sensitive material of each sheet, thereby preventing high quality image recording.

SUMMARY OF THE INVENTION

It is a principal object of the present invention to provide a method of controlling the feeding of sheets one by one in which a suction pad for attracting an uppermost sheet of stacked sheets is spaced from the uppermost sheet so that the sheets can reliably be fed one by one without pressing the suction pad against the uppermost sheet, and when a plurality of sheets attracted and held by the suction pad at a predetermined position is detected, the plurality of sheets are first released from the suction pad, and the suction pad is then moved to attract and hold the uppermost sheet to prevent a plural sheet feeding without stopping a sheet feeding device.

It is another principal object of the present invention to provide a device for controlling the feeding of sheets one by one of a type wherein magnitude in proportion to the degree of the flexion of an uppermost sheet attracted and held by a suction pad can be detected by a sheet-feed detecting mechanism facing the sheet attracted by the suction pad, thereby making it possible to reliably detect plural sheet feeding.

It is another object of the present invention to provide a method of controlling the feeding of sheets one by one, the method comprising the following steps: a first step of displacing downwards a suction pad at a low speed in a position near a stack of sheets so as to approach an uppermost sheet of the sheets, thereby attracting the uppermost sheet to the suction pad, a second step of flexing the uppermost sheet with sheet pressing means while the uppermost sheet is being separated away from other sheets, a third step of detecting whether or not the suction pad has attracted and held a single sheet by detecting magnitude in proportion to the degree of flexion of the uppermost sheet, a fourth step of displacing the suction pad again towards the position where the uppermost sheet is to be attracted when it is detected in the third step that the suction pad has attracted and held a plurality of sheets, a fifth step of stopping the sucking operation at a predetermined position, thereby releasing the plurality of sheets from the suction pad, a sixth step of detecting whether or not the plurality of sheets have been released from the suction pad in the fifth step, and a seventh step of displacing the suction pad again towards the position where the uppermost sheet is to be attracted after the plurality of sheets have been released from the suction pad, so as to attract and hold the uppermost sheet.

It is a further object of the present invention to provide the method wherein when it is detected in the third step that the suction pad has attracted and held the plurality of sheets, the fourth step is performed, followed by returning to the second step without performing the fifth and sixth steps, after which the second through seventh steps are repeated.

It is a still further object of the present invention to provide a device for controlling the feeding of sheets one by one, the device comprising a suction pad for attracting an uppermost sheet of stacked sheets so as to feed the uppermost sheet to a predetermined position, sheet pressing means facing the uppermost sheet attracted by the suction pad, disposed in the vicinity of the suction pad the sheet pressing means including a detecting head brought into abutment against the uppermost sheet, and a sensor for detecting the magnitude of displacement of the detecting head.

It is a still further object of the present invention to provide the device wherein the sensor is a photosensor comprising a light-emitting device and a light-detecting device, the sensor being activated to detect whether o not the suction pad has attracted the plurality of sheets when one end of a detecting rod extending from the detecting head is inserted between the light emitting device and the light-detecting device.

It is a still further object of the present invention to provide the device wherein the sensor s a displacement detecting sensor for detecting the magnitude of displacement of one end of a detecting rod extending from a detecting head, the sensor being activated to detect whether or not the suction pad has attracted the plurality of sheets based on the magnitude of the displacement thereof detected by the sensor.

It is a still further object of the present invention to provide a device for controlling the feeding of sheets one by one, the device comprising a suction pad for attracting an uppermost one of stacked sheets so as to feed the uppermost sheet to a predetermined position, sheet pressing means facing the uppermost sheet attracted by the suction pad, disposed in the vicinity of the suction pad, the sheet pressing means including a flexing member brought into abutment against a position in the vicinity of one end of the upper surface of the uppermost sheet upon feeding the uppermost sheet to the predetermined position, thereby flexing the uppermost sheet.

It is a still further object of the present invention to provide a device for controlling the feeding of sheets one by one, the device comprising a suction pad for attracting an uppermost sheet of stacked sheets so as to feed the uppermost sheet to a predetermined position, sheet pressing means facing the uppermost sheet attracted by the suction pad, disposed in the vicinity of the suction pad the sheet pressing means including a detecting head brought into abutment against the uppermost sheet, a sensor for detecting the magnitude of displacement of the detecting head, and a flexing member for flexing the uppermost sheet.

It is a still further object of the present invention to provide a device for controlling the feeding of sheets one by one, the device comprising a suction pad for attracting an uppermost one of stacked sheets so as to feed the uppermost sheet to a predetermined position, sheet pressing means facing the uppermost sheet attracted by the suction pad, disposed in the vicinity of the suction pad, hydraulic fluid feeding means disposed near the suction pad to feed hydraulic fluid towards a side edge portion of the uppermost sheet attracted by the suction pad.

It is a still further object of the present invention to provide the device wherein the sheet pressing means comprises a flexing member brought into abutment against a position in the vicinity of one end of the upper surface of the uppermost sheet upon feeding the uppermost sheet to the predetermined position, for flexing the uppermost sheet.

It is a still further object of the present invention to provide the device wherein the sheet pressing means comprises a detecting head brought into abutment against the uppermost sheet, a sensor for detecting magnitude of displacement of the detecting head, and a flexing member for flexing the uppermost sheet.

The above and other objects, features and advantages of the present invention will become apparent from the following description and the appended claims, taken in conjunction with the accompanying drawings in which a preferred embodiment of the present invention is shown by way of illustrative example.

DETAILED DESCRIPTION OF THE PREFERRED EMBODIMENTS

Figure 1:
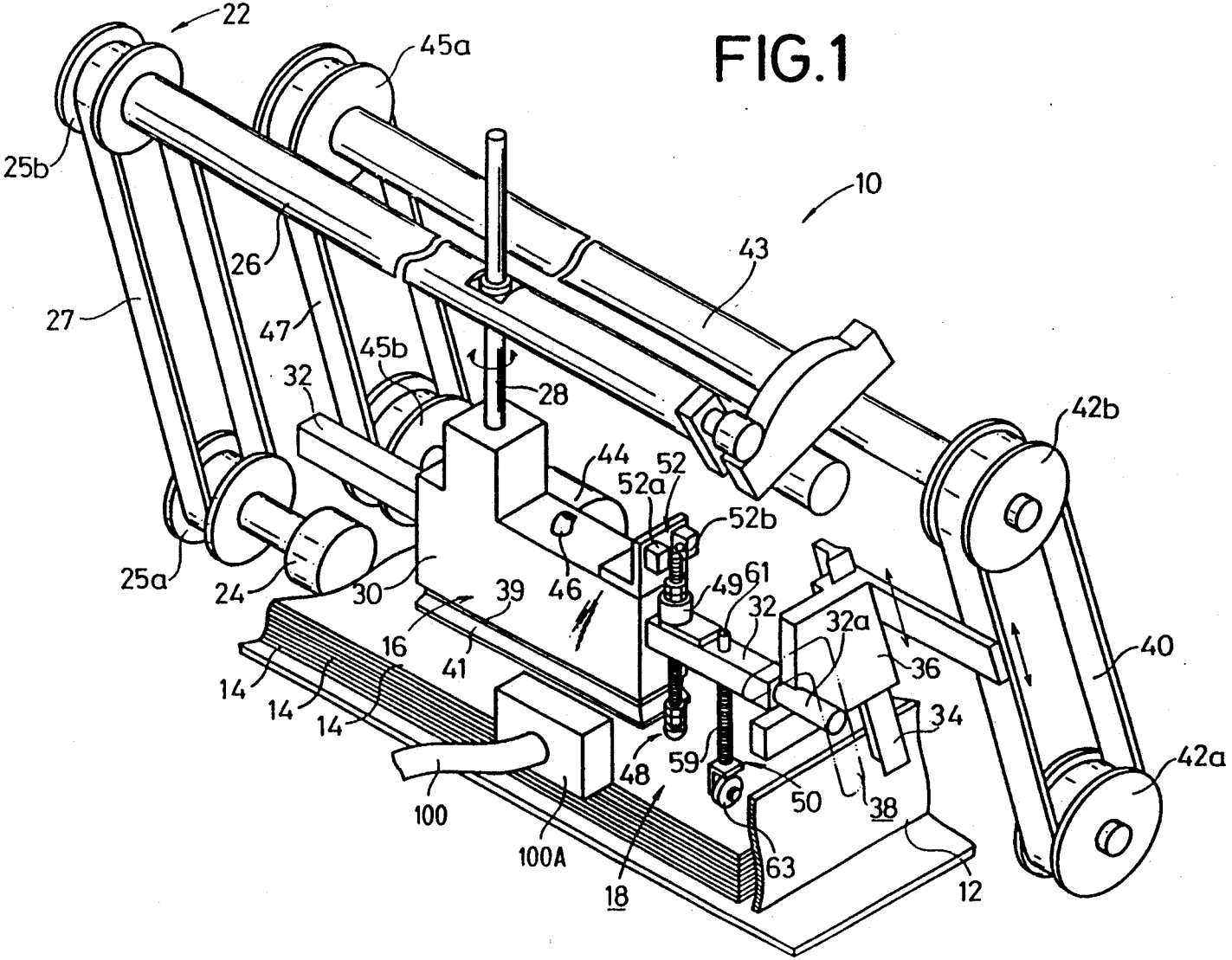
FIG. 1 is a perspective view schematically showing a sheet-feed control device for carrying out a method of controlling the feeding of sheets one by one, according to one embodiment of the present invention.

FIG. 1 shows a device 10 for controlling the feeding of sheets one by one, which is used to carry out a method of controlling the feeding of sheets one by one, according to one embodiment of the present invention. In the drawing, the sheet feed control device 10 comprises a suction cup or pad 16 for successively attracting and holding photographic light-sensitive mediums 14 as sheets, which are accommodated in a supply magazine 12 in a stacked state, and a sheet pressing mechanism 18 disposed in a position near the suction pad 16, wherein the pressing means 18 abuts against an uppermost sheet in the vicinity of one end of the stacked photographic light-sensitive mediums 14. The supply magazine 12 is used in the present embodiment but the present invention is not necessarily limited to such a supply magazine 12. Any structure in which sheets can be stacked and placed may also be used.

The suction pad 16 and the sheet pressing mechanism 18 are displaceable in unison with each other by a drive mechanism 22. The drive mechanism 22 has a rotative drive source 24, and a guide bar 28 is inserted, at right angles, into a rotatable shaft 26 which is coupled to the rotative drive source 24 by a pair of pulleys 25*a*, 25*b* and a belt 27. In addition, a block-shaped holder 30 is fixed to the guide bar 28, and a rod 32 is supported by the holder 30.

The rod 32 has a cylindrical portion 32*a* coupled to one end thereof. The leading end of the cylindrical portion 32*a* is inserted into a guide groove 38 defined in a unillustrated side plate by way of a support plate 36 fitted on a linear guide bar 34. The support plate 36 is fixedly mounted on a belt 40. The belt 40 is wound around a pair of pulleys 42*a*, 42*b*, with one pulley 42*b* having a rotatable shaft 43 coupled to a rotative drive source 44 by a pair of pulleys 45*a*, 45*b* and a belt 47.

The suction pad 16 is mounted on the holder 30 which communicates with an unillustrated suction pump via a pipe 46.

The suction pad 16 comprises an inflexible base 39 shaped substantially in the form of a rectangular parallelepiped, and a flexible main body 41. The wall of the base 39 has enough thickness not to be deformed while the suction pad 16 is drawing a photographic light-sensitive medium 14 under suction, whereas the wall of the main body 41 is thin in thickness so as to attract and hold a photographic light-sensitive medium 14 while it is being drawn by the suction pad 16.

The sheet pressing mechanism 18 has a sheet-feed detecting mechanism 48 disposed near the suction pad 16, for detecting plural sheet feeding and a sheet presser 50.

Figure 2:
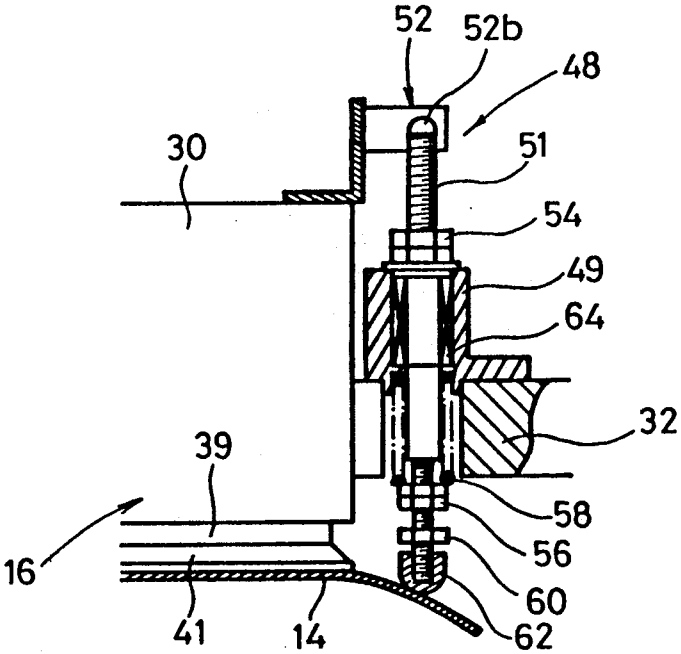
FIG. 2 is a vertical cross-sectional view showing an essential part of a sheet detecting mechanism.
Figure 4:
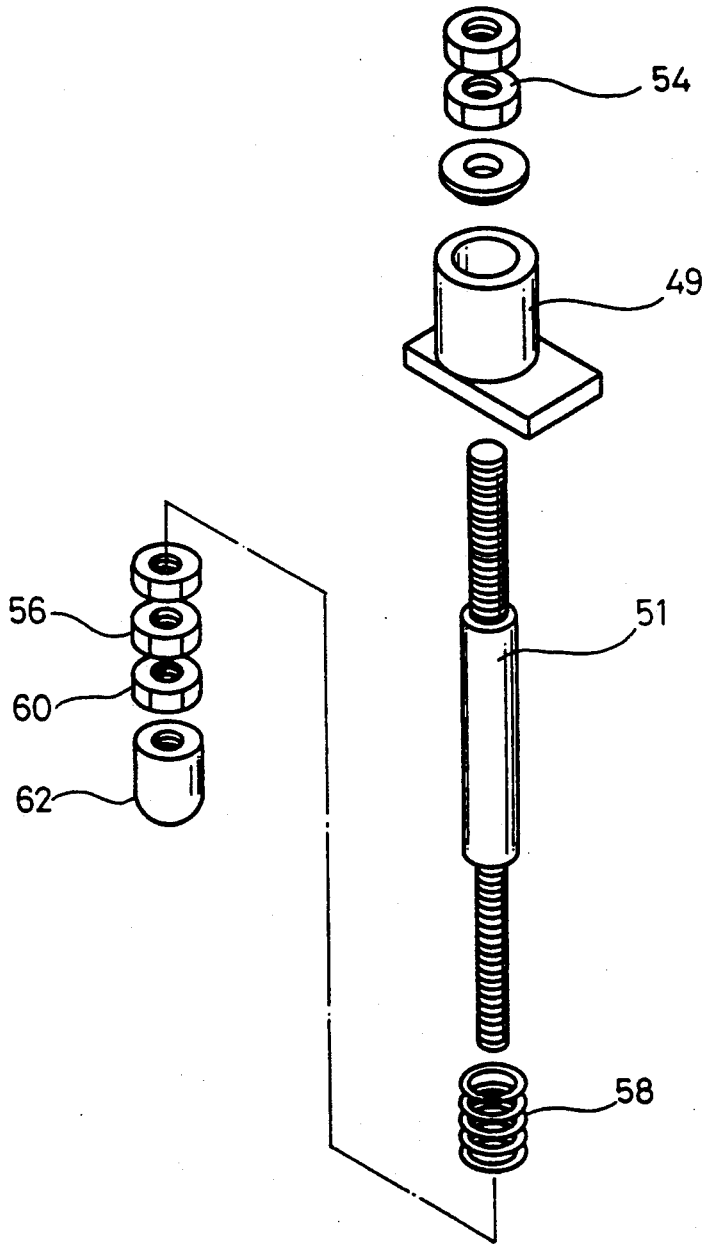
FIG. 4 is an exploded perspective view showing the essential part of the sheet detecting mechanism shown in each of FIGS. 2 and 3.

As shown in FIGS. 2 and 4, the detecting mechanism 48 comprises a boss-shaped seat 49 disposed near the suction pad 16 and fixedly mounted on the rod 32, a detecting rod 51 supported on the seat 49, and a photosensor 52 fixedly mounted on the holder 30. The detecting rod 51 has three, i.e., first, second and third adjusting members. The first adjusting member is located on the seat 49 and is made up of a screw 54 for adjusting the length of the upper part of the detecting rod 51 above the seat 49, the detecting rod 51 being moved upward and downward between a light-emitting device 52*a* and a light-detecting device 52*b* of the photosensor 52 (see FIG. 1). A screw 56 as the second adjusting member is disposed below the seat 49 and is held against a lower end portion of a compression coil spring 58 in order to adjust or control the pressure of the compression coil spring 58 having an upper end portion fitted in a ring-shaped recess at the lower part of the seat 49. The third adjusting member is a screw 60 for adjusting the vertical position of a detecting head 62 made of synthetic resin, which is disposed in a lower end portion of the detecting rod 51. An oil less bearing 64 for supporting the detecting rod 51 thereon is disposed in the seat 49, so that the detecting rod 51 can smoothly move up and down.

Figure 3:
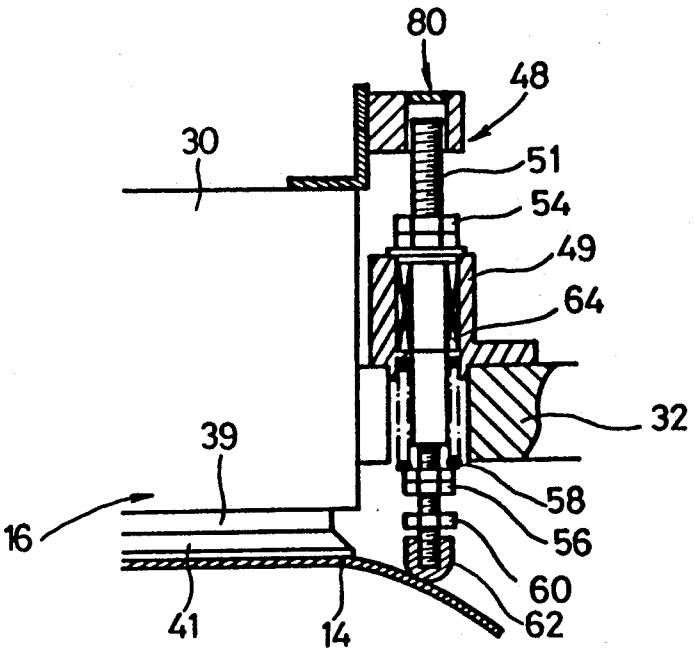
FIG. 3 is a vertical cross-sectional view illustrating an essential part of another example of the sheet detecting mechanism.

FIG. 3 shows one, example of a sheet detecting mechanism using a sensor 80 for detecting the magnitude of displacement of the upper end portion of the detecting rod 51 in place of the photosensor 52 shown in FIG. 2. The detecting mechanism shown in FIG. 3 is structurally identical to that illustrated in FIG. 2 except for the photosensor 52.

The sheet presser 50 comprises a rod member 61 which is urged to move toward the stacked photographic light-sensitive mediums 14 under the bias of a coil spring 59 disposed around the rod member 61 and which is axially movably supported on the rod 32, and a roller 63, mounted on the lower end of the rod member 61, for bringing into contact with the uppermost photographic light-sensitive medium 14 which has been attracted and held by the suction pad 16 in the vicinity of the edge of the sheet 14.

On the other hand, there is disposed an ar blower 100A at a height between the uppermost photographic light-sensitive medium 14 and the suction pad 16. The air blower 100A has an air outlet (not shown) directed to the photographic light-sensitive medium 14. A tube 100, which communicates with an unillustrated air supply source, communicates with the air outlet.

A description will now be made of a conveying system in which the device 10 constructed as described above is to be incorporated, with reference to FIG. 5.

There is disposed a guide roller 66 near a position at which each of photographic light-sensitive mediums 14 is taken out from the supply magazine 12. In addition, there is also disposed a conveying mechanism 70 for delivering an uppermost photographic light-sensitive medium 14 taken out from the supply magazine 12 toward an outlet 68 on the side of an unillustrated automatic photographic processor. The conveying mechanism 70 has a plurality of rollers 72*a* through 72*d*, 73*a* through 73*d*, and belts 74, 75 wound therearound respectively. In the conveying mechanism 70, a photographic light sensitive medium 14 is first transported downwards and succeedingly upwards as shown in FIG. 5 by the rollers 72*a* through 72*d*, 73*a* through 73*d* and the belts 74, 75. Thereafter, the photographic light-sensitive medium 14 is horizontally transported from the conveying mechanism 70 through guide plates 76*a* through 76*c* and a pair of rollers 77, and fed from the outlet 68 into the automatic photographic processor.

The aforementioned method is carried out by means of the device 10 constructed as described above will now be described in detail with reference to flowcharts shown in FIGS. 6 and 7.

Figure 5:
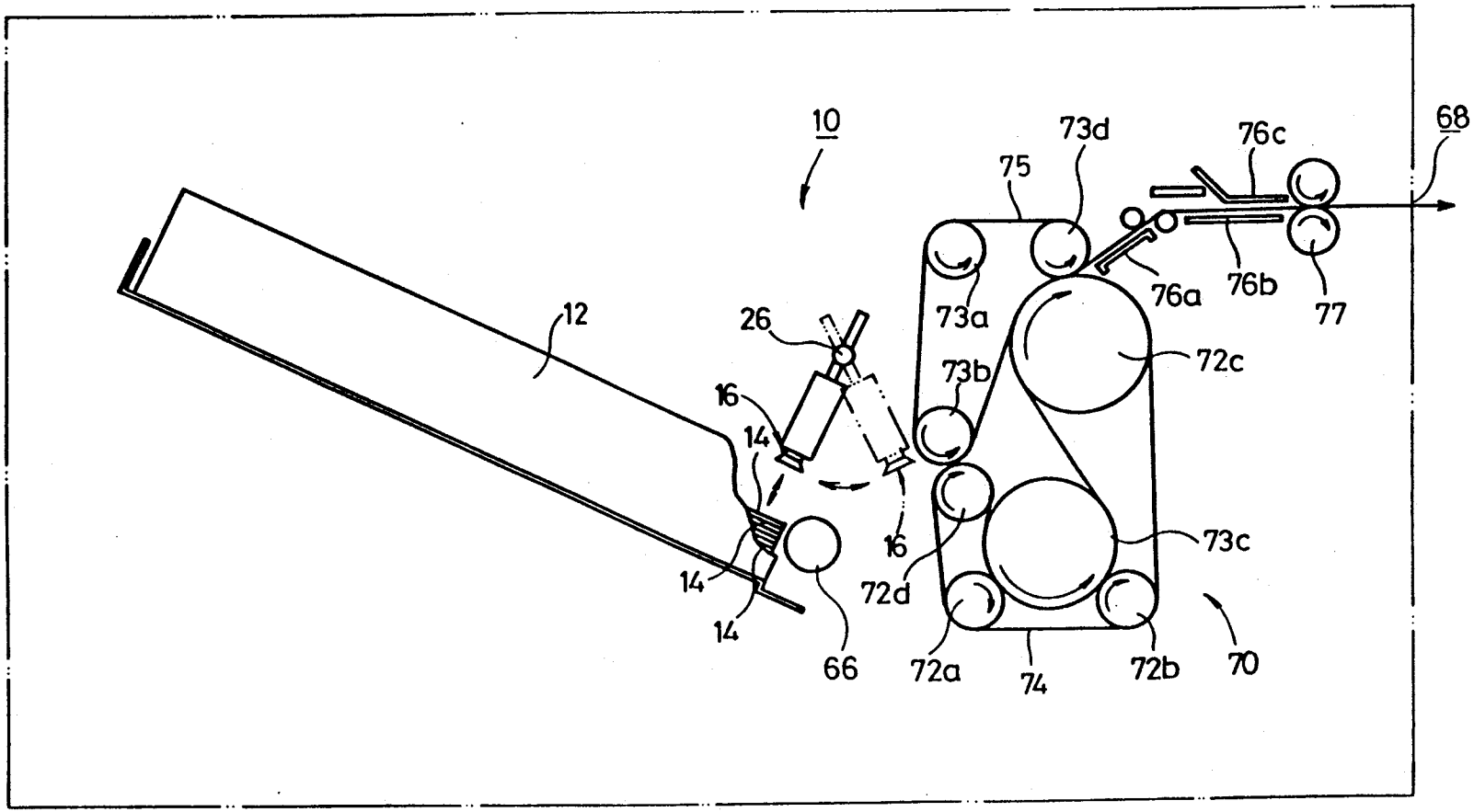
FIG. 5 is a schematic view illustrating a conveying system in which a sheet feeding device is incorporated.

As shown in FIG. 5, the supply magazine 12 loaded with a plurality of stacked photographic light-sensitive mediums 14 is loaded in the device 10. As shown in FIG. 1, the rotative drive source 44 is then energized to cause the pulleys 45*a*, 45*b*, the belt 47, the rotatable shaft 43, the pulleys 42*a*, 42*b*, the belt 40 and the support plate 36 to displace the holder 30 fixed to the rod 32 toward the supply magazine 12 from the reference position along the linear guide bar 34 at a high speed (e.g., 150 mm/sec.) (see Step S1 in FIG. 6). Then, the suction pad 16 is moved downward at the high speed so as to reach a position near the surface of the uppermost photographic light-sensitive medium 14 (see Step S2 in FIG. 6 and A positions shown in FIGS. 8 and 9).

After the speed at which the suction pad 16 is lowered is reduced to a low speed (e.g., 6 mm/sec.) (see Step S3 in FIG. 6), the movement of the suction pad 16 is stopped with a slight space between the suction pad 16 and the photographic light-sensitive medium 14 (see Step S4 in FIG. 6). Under this condition, an unillustrated vacuum pump is activated to subject the inside of the suction pad 16 to a vacuum, thereby making it possible to attract under suction the uppermost photographic light-sensitive medium 14 in the supply magazine 12 by the suction pad 16 although the suction pad 16 is slightly spaced from the uppermost photographic light-sensitive medium 14 (see B positions shown in FIGS. 8 and 9).

Figure 6:
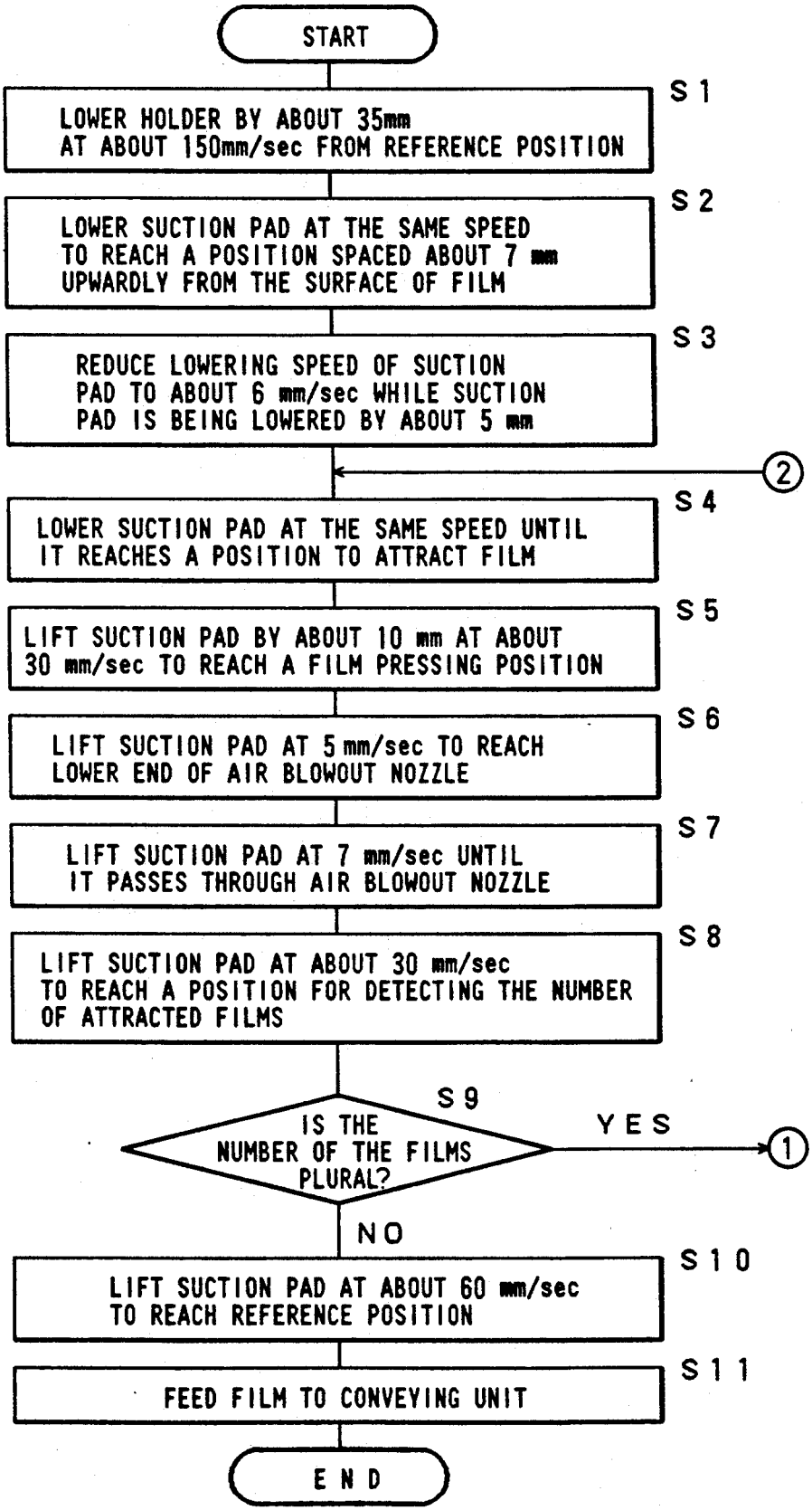
FIGS. 6 and 7 are flowcharts for describing processing sequences of the method shown in FIG. 1.
Figure 9:
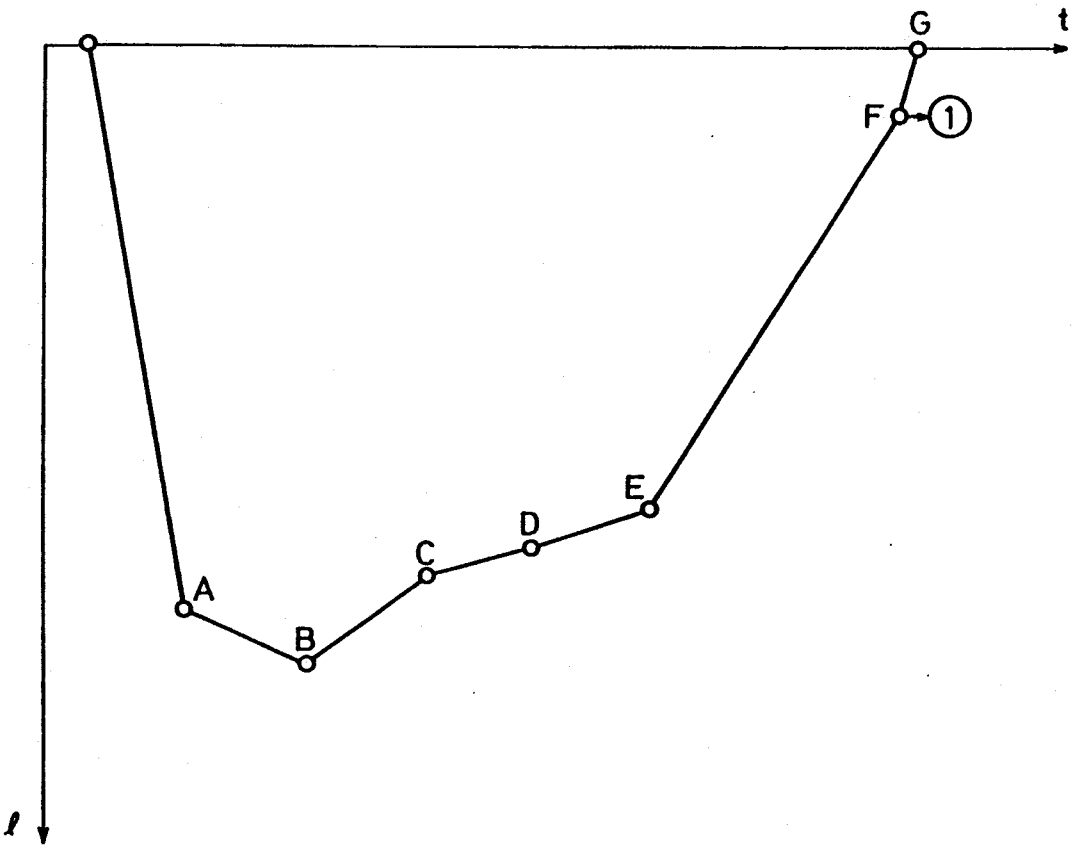
FIG. 9 is a view for describing the relationship between each travel speed of a suction pad employed in the method shown in FIG. 1 and the distance between the reference position of the suction pad and the surface of each sheet.
Figure 8:
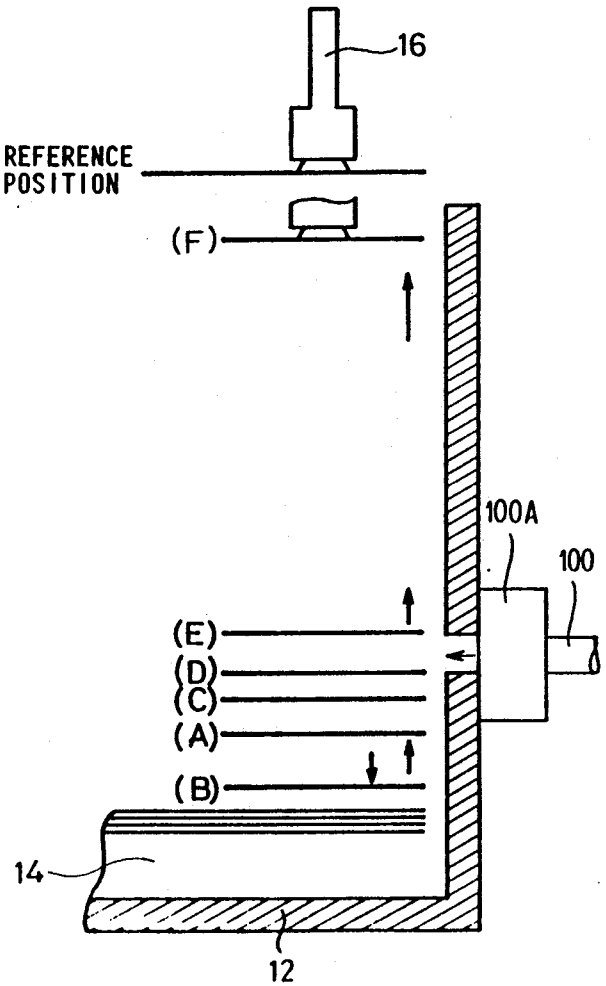
FIG. 8 is a view for describing respective positions at which a suction pad is displaced toward an uppermost one of stacked sheets in a magazine.

Then, the suction pad 16 is moved upward at a medium speed by a given distance (see Step S5 in FIG. 6 and C positions illustrated in FIGS. 8 and 9). Thereafter, the suction pad 16 is moved upwards at an increased speed (see Step S6 in FIG. 6 and D positions shown in FIGS. 8 and 9). Then, the suction pad 16 is further moved upwards at a reduced speed near an air blowout hole or nozzle of the air blower 62 (see Step S7 in FIG. 6 and E positions shown in FIGS. 8 and 9). During this operation, compressed air is supplied by the air blower 100A from the tube 100 to the side edge of each of a plurality photographic light-sensitive media 14 which are fed one by one from a stack of photographic light-sensitive mediums 14. During this blowing period, the roller 63 of the sheet presser 50 abuts against the corner of the uppermost photographic light-sensitive medium 14, thereby flexing the same. Thus, when a plurality of photographic light-sensitive mediums 14 is attracted by the suction pad 16, the uppermost sheet can reliably be separated from the next uppermost photographic light-sensitive medium 14 by introducing air between the uppermost photographic light-sensitive medium 14 and the next light sensitive medium adjacent thereto.

Thereafter, the suction pad 16 is lifted at a medium speed (e.g., 30 mm/sec.) to a given position (see Step S8 in FIG. 6 and F positions shown in FIGS. 8 and 9). Then, the detecting mechanism 48 detects whether or not a plurality of photographic light-sensitive mediums 14 have been attracted under suction by the suction pad 16 (see Step S9 in FIG. 6).

A plural sheet feeding is determined depending on whether or not the sensor is 52 activated by the upper end of the detecting rod 51 in response to the balance between the resilient force of the compression coil spring 58 mounted on the detecting mechanism 48 and the rigidity of the photographic light-sensitive medium 14 to be fed.

More specifically, when each photographic light sensitive medium 14 is attracted and held by the suction pad 16, the detecting head 62 of the detecting mechanism 48, which extends downward from the base 39 of the suction pad 16, is activated to flex the photographic light-sensitive medium 14 as shown in FIG. 2. If only an uppermost photographic light-sensitive medium 14 is attracted and held by the suction pad 16 at this time, then the uppermost photographic light-sensitive medium 14 is flexed downwardly by the lower end of the detecting rod 51, so that the upper end of the detecting rod 51 does not enter between the light-emitting device **52*a* and the light-detecting device 52*b* of the photosensor 52. As a result, the photosensor 52 does not generate a signal. On the other hand, when a plurality of photographic light-sensitive mediums 14 are attracted under suction by the suction pad 16, the degree of the rigidity of the photographic light-sensitive mediums 14 is increased so that the upper end of the detecting rod 51 enters between the light-emitting device 52*a* and the light-detecting device 52*b*, thus detecting that a plurality of photographic light-sensitive mediums 14** have been fed simultaneously.

When different types of photographic light sensitive mediums 14 are stored in the supply magazine 12, the rigidity of such photographic light-sensitive mediums 14 may be different from the other. Therefore, the type of the photographic light-sensitive mediums 14 can be determined by the photosensor 52 activated by the upper end of the detecting rod 51 of the detecting mechanism 48 in FIG. 2 or by the sensor 80 based on the magnitude of the displacement of the upper end of the detecting rod 51 in FIG. 3. Accordingly, it is further possible to change sheet feeding operation (e.g., sheet swinging motion) or processing conditions according to the types of the photographic light-sensitive mediums 14. If it is detected that the suction pad 16 has attracted and held a single photographic light sensitive medium 14, then the suction pad 16 is lifted, i.e., moved upward at a high speed (e.g., 60 mm/sec.) to the reference position (see Step S10 and G positions shown in FIGS. 8 and 9).

When the suction pad 16 reaches a predetermined position upon continued operation of the rotative drive source 44, the rotative drive source 44 is de-energized, and the rotative drive source 24 is energized to cause the rotatable shaft 26 to turn the rod 32 in a given angular range, thereby feeding the photographic light-sensitive medium 14 attracted and held by the suction pad 16 toward the conveying mechanism 70 (see Step S11 in FIG. 6).

The suction pad 16 is now inactivated, thereby releasing the photographic light-sensitive medium 14. After the photographic light-sensitive medium 14 is first delivered downwards, delivered upwards by the rollers **72*a* through 72*d*, 73*a* through 73*d* and the belts 74, 75 and thereafter guided horizontally through the guide plates 76*a* through 76*c*. Then, the photographic light-sensitive medium 14 is delivered from the outlet 68** into the automatic photographic processor.

If it is detected in Step S9 in FIG. 6 that the plurality of photographic light sensitive mediums 14 have been attracted and held by the suction pad 16, then the suction pad 16 is displaced again at a high speed toward the position where the photographic light-sensitive medium 14 is attracted and held by the suction pad 16 (see Step S12 in FIG. 7), thereby stopping the suction pad 16 at a given position (see the D position shown in each of FIGS. 8 and 9). Then, an unillustrated suction pump is inactivated to release from vacuum by a solenoid valve, for example, thereby releasing the plurality of photographic light-sensitive mediums 14 attracted and held by the suction pad 16 therefrom (see Step S13 in FIG. 7 and an H position shown in FIG. 10).

Figure 7:
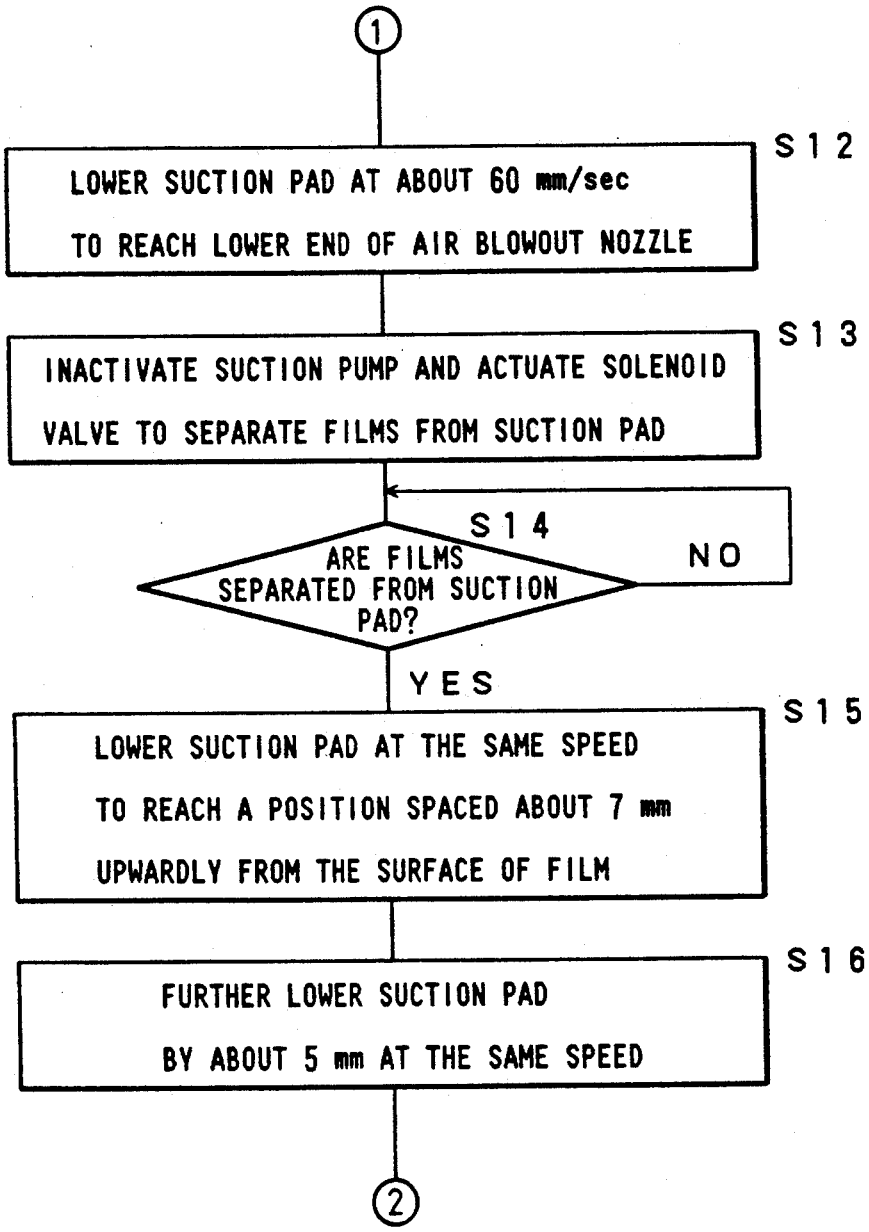
Figure 10:
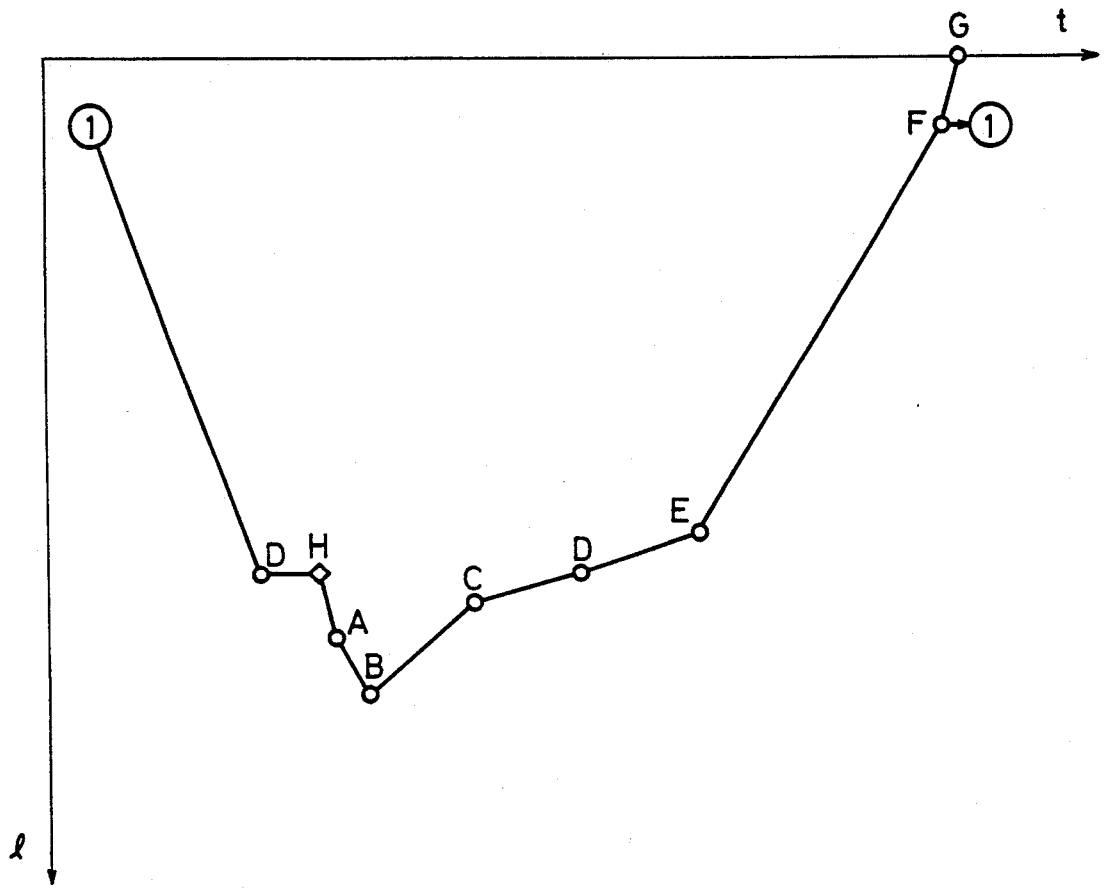
FIG. 10 is a view for describing the relationship between the travelling speed of the suction pad from an F position shown in FIG. 9 and the distance from the suction pad to the surface of the stacked sheets.

When the detecting mechanism 48 detects that the photographic light-sensitive mediums 14 have been released from the suction pad 16 in accordance with the above releasing process (see Step S14 in FIG. 7), the suction pad 16 is moved again at a high speed toward the position where the photographic light-sensitive medium 14 s attracted and held (see Step S15 in FIG. 7 and an A position shown in FIG. 10). Then, after the descending speed of the suction pad 16 is reduced (see Step S16 shown in FIG. 7), the suction pad 16 is stopped with a slight space between the suction pad 16 and the uppermost photographic light-sensitive medium 14. Then, a process for attracting and holding the photographic light-sensitive medium 14 with the suction pad 16 is repeated again (see a B position shown in FIG. 10).

In case, a plural number of the photographic light-sensitive mediums 14 attracted and held by the suction pad 16 is detected, suction pad 16 which remains under a vacuum, i.e., the suction pad 16 which have attracted and held plurality of photographic light-sensitive mediums 14, is displaced toward the supply magazine 12 at a high speed so as to approach the uppermost photographic light-sensitive medium 14, without performing the above-described steps S12 through S16. Then, the descending speed of the suction pad 16 is reduced, and the suction pad 16 is inactivated with a slight space between the suction pad 16 and the photographic light-sensitive medium 14. Thereafter, the steps S6 through S9 referred to above may be carried out again.

In the present embodiment, as an example of the sheet, an exposed photographic light-sensitive medium 14 may be employed. However, the present invention is not necessarily limited to the present embodiment, but an unexposed photographic light-sensitive medium such as X ray film or graphic art film, may also be employed in the same manner as described above. As a sensor, the photosensor is employed as a preferred example in the present embodiment. However, devices such as a linear encoder, a potentiometer, etc. may also be used n accordance with the operation of the detecting rod. It is therefore possible to detect the number of sheets based on the magnitude of the displacement of the detecting rod.

As described above, the aforementioned method and the device 10 according to the present invention can bring about the following advantageous effects.

The travel speed of a suction pad is reduced at a position near sheets, and the uppermost sheet of the sheets is attracted and held by the suction pad with a space between the suction pad and the sheet Therefore, the suction pad does not press against a stack of thin film sheets, and hence such sheets can reliably be fed one by one.

If it is detected that a plurality of sheets have been attracted and held by the suction pad, then a suction pump is inactivated at a predetermined position of the suction pad, so that the sheets are released from the suction pad, followed by displacing again the suction pad toward the position where the uppermost sheet is attracted so as to re-start sheet attracting operation. Alternatively, regardless of the release of the sheets from the suction pad, the suction pad is displaced again toward the position to re-start the sheet attracting operation. As a consequence, the sheets can automatically be fed one by one without stopping the device, thereby making it possible to deliver a single sheet to a desired position. Accordingly, the photographic light-sensitive mediums or sheets can more efficiently be fed one by one from the supply magazine.

According to the present invention, the uppermost sheet of a stack of sheets is attracted and held by the suction pad. Then, a sheet detecting mechanism is brought into contact with the uppermost sheet, and the magnitude of displacement of a detecting rod due to the repulsion of the flexion of the uppermost sheet, is detected by a sensor of the detecting mechanism. It is therefore possible to accurately detect a plural sheet feeding by the suction pad or the type of sheets.

Having now fully described the invention, it will be apparent to those skilled in the art that many changes and modifications can be made without departing from the spirit or scope of the invention as set forth herein.

What is claimed is:

1. A method of controlling the feeding of sheets one-by-one, said method comprising the following steps:

a first step of downwardly displacing a suction pad to a position adjacent a stack of sheets so as to approach an uppermost sheet of the stack of sheets, thereby attracting said uppermost sheet to said suction pad;

a second step of flexing said uppermost sheet with sheet pressing means while said uppermost sheet is being separated from other sheets, said suction pad and said sheet pressing means being displaceable in unison;

a third step of detecting, according to the degree of flexion of said uppermost sheet, whether said suction pad attracts and holds a single sheet;

a fourth step of displacing said suction pad again toward the position where said suction pad attracts said uppermost sheet, when it is detected in said third step that said suction pad has attracted and held a plurality of sheets;

a fifth step of inactivating said suction pad at a predetermined position so as to release said plurality of sheets from said suction pad;

a sixth step of detecting whether said plurality of sheets have been released from said suction pad in said fifth step; and a seventh step of displacing said suction pad again toward the position where said suction pad attracts said uppermost sheet after said plurality of sheets have been released from said suction pad, so as to attract and hold said uppermost sheet.

2. A method according to claim 1, wherein when it is detected in said third step that said suction pad has attracted and held a plurality of sheets, said fourth step is performed, followed by returning to said second step without performing said fifth and sixth steps, after which said second through seventh steps are repeated.

3. A device for controlling the feeding of sheets one-by-one, said device comprising:

a suction pad for attracting an uppermost sheet of stacked sheets so as to feed said uppermost sheet to a predetermined position;

means, facing said uppermost sheet attracted by said suction pad and being disposed in the vicinity of said suction pad, for pressing said uppermost sheet, said suction pad and said sheet pressing means being displaceable in unison, said sheet pressing means including:

a detecting head for abutting said uppermost sheet;

a sensor for detecting the magnitude of displacement of said detecting head; and a flexing member for flexing said uppermost sheet.

4. A device according to claim 3, wherein said sensor comprises a photosensor comprising a light-emitting device and a light-detecting device, said sensor being activated to detect whether said suction pad has attracted a plurality of sheets when one end of a detecting rod extending from said detecting head is located between said light-emitting device and said light-detecting device.

5. A device for controlling the feeding of sheets one-by-one, said device comprising:

a suction pad for attracting an uppermost sheet of stacked sheets so as to feed said uppermost sheet to a predetermined position;

means, facing said uppermost sheet attracted by said suction pad and being disposed in the vicinity of said suction pad, for pressing said uppermost sheet, said suction pad and said sheet pressing means being displaceable in unison, said sheet pressing means including means for detecting an amount of rigidity of said uppermost sheet so as to selectively change a sheet feeding notion of said device; and means, disposed adjacent said suction pad, for feeding fluid toward a side edge portion of said uppermost sheet attracted by said suction pad.

6. A device according to claim 5, wherein said sheet pressing means comprises a flexing member for abutting against a position in the vicinity of one end of the upper surface of said uppermost sheet upon lifting said uppermost sheet, thereby flexing said uppermost sheet.

7. A device according to claim 5, wherein said detecting means comprises a detecting head brought into abutment against said uppermost sheet and a sensor for detecting the magnitude of displacement of said detecting head, said sheet pressing means further comprising a flexing member for flexing said uppermost sheet.

* * * * *